US005159193A

United States Patent [19]

Shiraishi et al.

[11] Patent Number: 5,159,193

[45] Date of Patent: Oct. 27, 1992

[54] OPTICAL UNIT FOR USE IN LASER BEAM PRINTER OR THE LIKE WITH TEMPERATURE EXPANSION COMPENSATION

[75] Inventors: Takashi Shiraishi, Tokyo; Masao Yamaguchi, Yokohama; Ken Omura, Tokyo; Naruhito Yoshida, Yokohama, all of Japan

[73] Assignee: Kabushiki Kaisha Toshiba, Kawasaki, Japan

[21] Appl. No.: 622,018

[22] Filed: Dec. 4, 1990

[30] Foreign Application Priority Data

Dec. 8, 1989 [JP] Japan ..... 1-317844

[51] Int. Cl.[5] ..... H01J 3/14

[52] U.S. Cl. ..... 250/236; 250/238

[58] Field of Search ..... 250/216, 238, 234, 235, 250/236, 239; 359/213, 214, 217, 224, 216; 348/108, 160

[56] References Cited

U.S. PATENT DOCUMENTS 4,297,713 10/1981 Ichikawa et al. ..... 346/108
4,818,046 4/1989 Kondo ..... 250/236
4,847,644 7/1989 Oda et al. ..... 359/218
4,884,857 12/1989 Prakash et al. ..... 359/217

*Primary Examiner*—David C. Nelms
*Attorney, Agent, or Firm*—Foley & Lardner

[57] ABSTRACT

In an optical unit used for a laser beam printer, a laser beam generated by a laser diode is converted by a group of conversion lenses into a laser beam having a predetermined-size cross section. The laser beam is directed toward a photosensitive body by a scanner. A focusing lens allows the rotating angle of the reflecting faces of the scanner to correspond to a desirable point on the surface of the photosensitive body. In other words, the rotating angle is made to correspond to the distance between the optical axis center determined with respect to a main scanning direction and a point to which the laser beam is irradiated for scanning. The conversion lenses includes at least one aspheric glass lens arranged close to the laser diode. The glass lens and the laser diode are integrally held by a lens barrel which linearly expands in a predetermined manner in response to a temperature change. Since the distance between the glass lens and the laser diode is constantly equal in accordance with the temperature change, the laser beam is constantly allowed to have a cross section of desirable size, without reference to the temperature change.

8 Claims, 6 Drawing Sheets

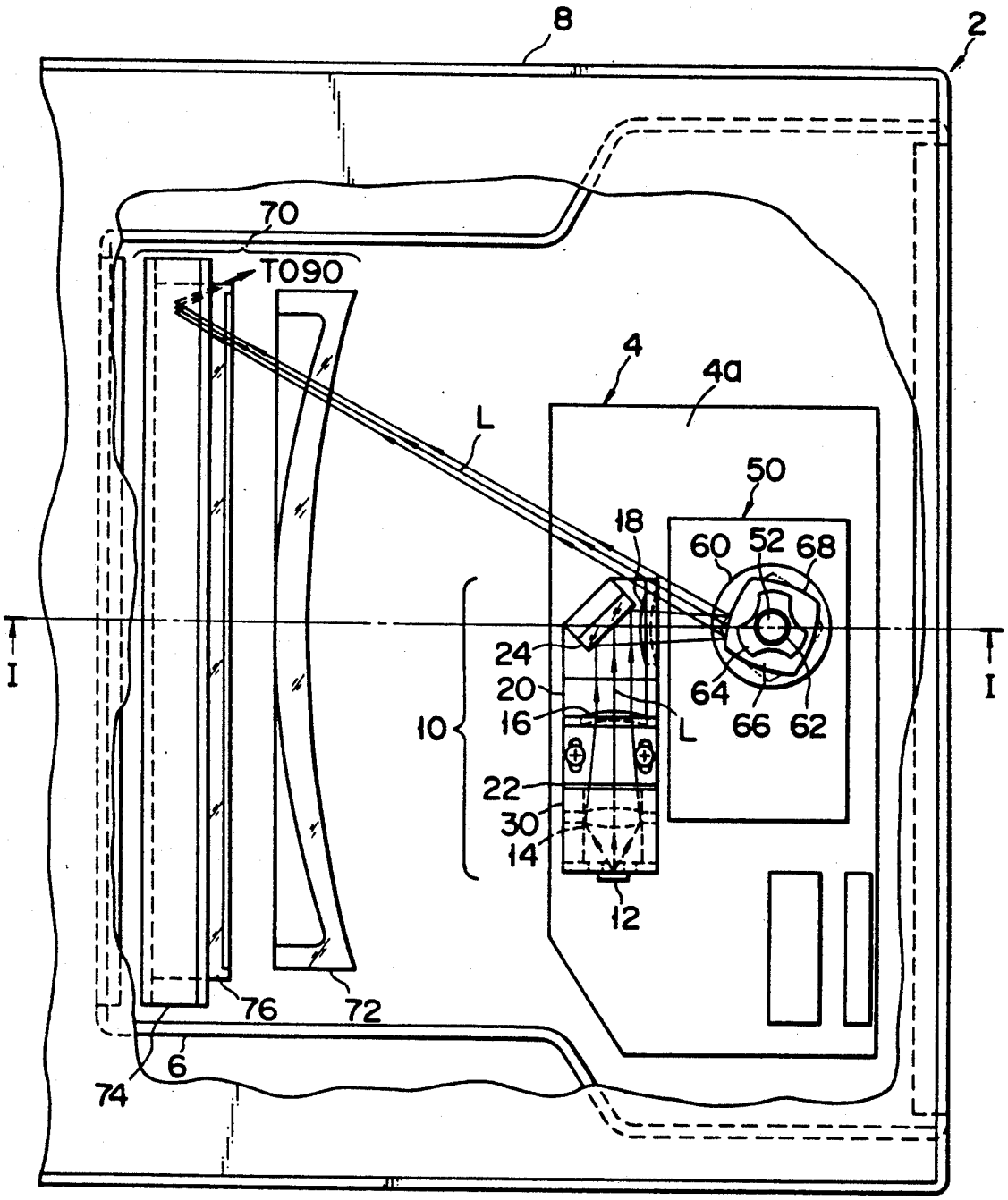
FIG. 1A
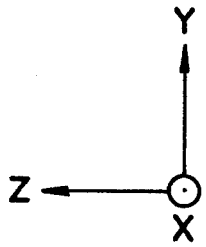

OPTICAL UNIT FOR USE IN LASER BEAM PRINTER OR THE LIKE WITH TEMPERATURE EXPANSION COMPENSATION

BACKGROUND OF THE INVENTION

1. Field of the Invention

The present invention relates to an optical unit for use in a laser beam printer, and more particularly to an optical unit which guides a laser beam from a laser diode to an object, by way of a group of focusing lenses and a scanner.

2. Description of the Related Art

In general, an optical unit incorporated in a laser beam printer or the like is designed such that a laser beam output from a laser diode is guided first to a scanner and then to a photosensitive body, i.e., an object to be scanned. The photosensitive body is scanned with the laser beam at a constant speed. When guided from the laser diode to the photosensitive body, the laser beam passes through a group of focusing lenses. By these focusing lenses, the laser beam is made to have a cross sectional shape having desirable characteristic, and then fall on the predetermined position on the surface of the photosensitive body.

This type of optical unit is made up of first and second optical systems which are isolated from each other. The first optical system converges the laser beam output from the laser diode, while the second optical system focuses the laser beam on the photosensitive body. The scanner is arranged between the first and second optical systems, as will be detailed later.

The first optical system is a combination of lenses, such as an aspheric glass lens, plastic lenses, etc. The laser beam generated from the laser diode is first converted into a substantially collimated laser beam by a collimator lens included in the first optical system, and is then guided to the second optical system. The second optical system is a combination of lenses, such as an $f\theta$ lens. By this $f\theta$ lens, the deflection angle at which a laser beam is deflected by the scanner is changed in proportion to the position at which the laser beam is focused on the photosensitive body and which is expressed in relation to the main scanning direction.

U S. Pat. No. 4,297,713 discloses a laser recording apparatus including a laser for emitting a laser beam and an optical unit for collimating the laser beam. In this laser recording apparatus, the distortion of a beam spot which arises from the beam-emitting angles determined with reference to both the vertical and horizontal directions is corrected by using a pair of cylindrical lenses arranged in close to the laser. Specifically, one of the cylindrical lenses is slid along the optical axis such that the cross section of the laser beam has a predetermined size and a predetermined shape.

In most of the presently-available laser diodes, however, the wavelength of a laser beam, the angle at which the laser beam is emitted, the efficiency at which the laser beam is emitted, and other parameters are adversely affected due to a temperature increase in the section where the laser diode is arranged. Thus, even when the optical unit shown in the U.S. Pat. No. 4,297,713 is used, it is likely that the cross section of the laser beam will not have a predetermined size or a predetermined shape.

SUMMARY OF THE INVENTION

Accordingly, an object of the present invention is to provide a structure which is incorporated in an optical unit employed in a laser beam printer or the like, and which reliably holds a glass lens and a laser diode while simultaneously preventing the focal length from varying in spite of changes in the ambient temperature.

Another object of the present invention is to provide an optical unit which is compact in size and which can be manufactured at low cost by use of inexpensive members or parts.

According to the present invention, there is provided an optical unit used for a printer apparatus comprising: means for generating a light beam; means for converting the light beam generated by said generating means into a convergent light beam; means for holding said generating means and said converting means in an integral manner such that the generating means and the converting means are isolated from each other by a distance corresponding to the temperature change.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and, together with the general description given above and the derailed description of the preferred embodiment given below, serve to explain the principles of the invention.

FIG. 1A is a plan view of an optical unit according to one embodiment of the present invention;

DETAILED DESCRIPTION OF THE PREFERRED EMBODIMENTS

An embodiment of the present invention will now be described, with reference to the accompanying drawings.

Figure 1B:
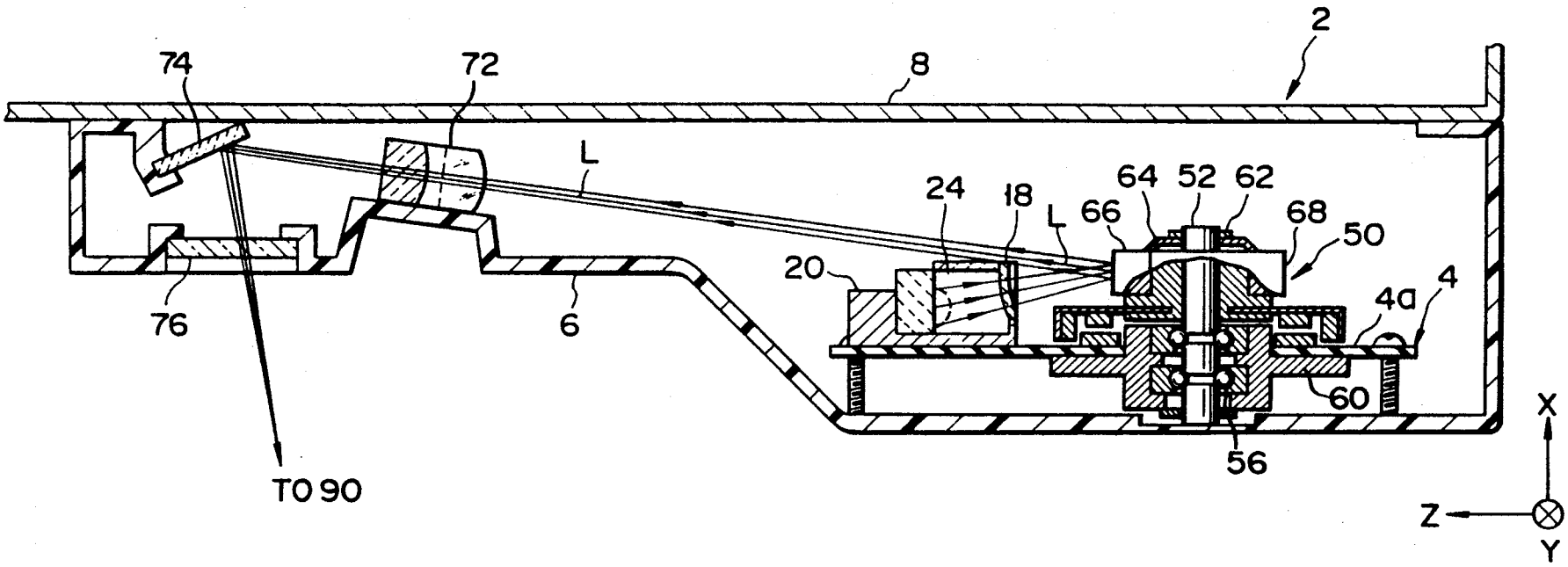
FIG 1B is a sectional view taken along line I—I in FIG. 1A.
Figure 2A:
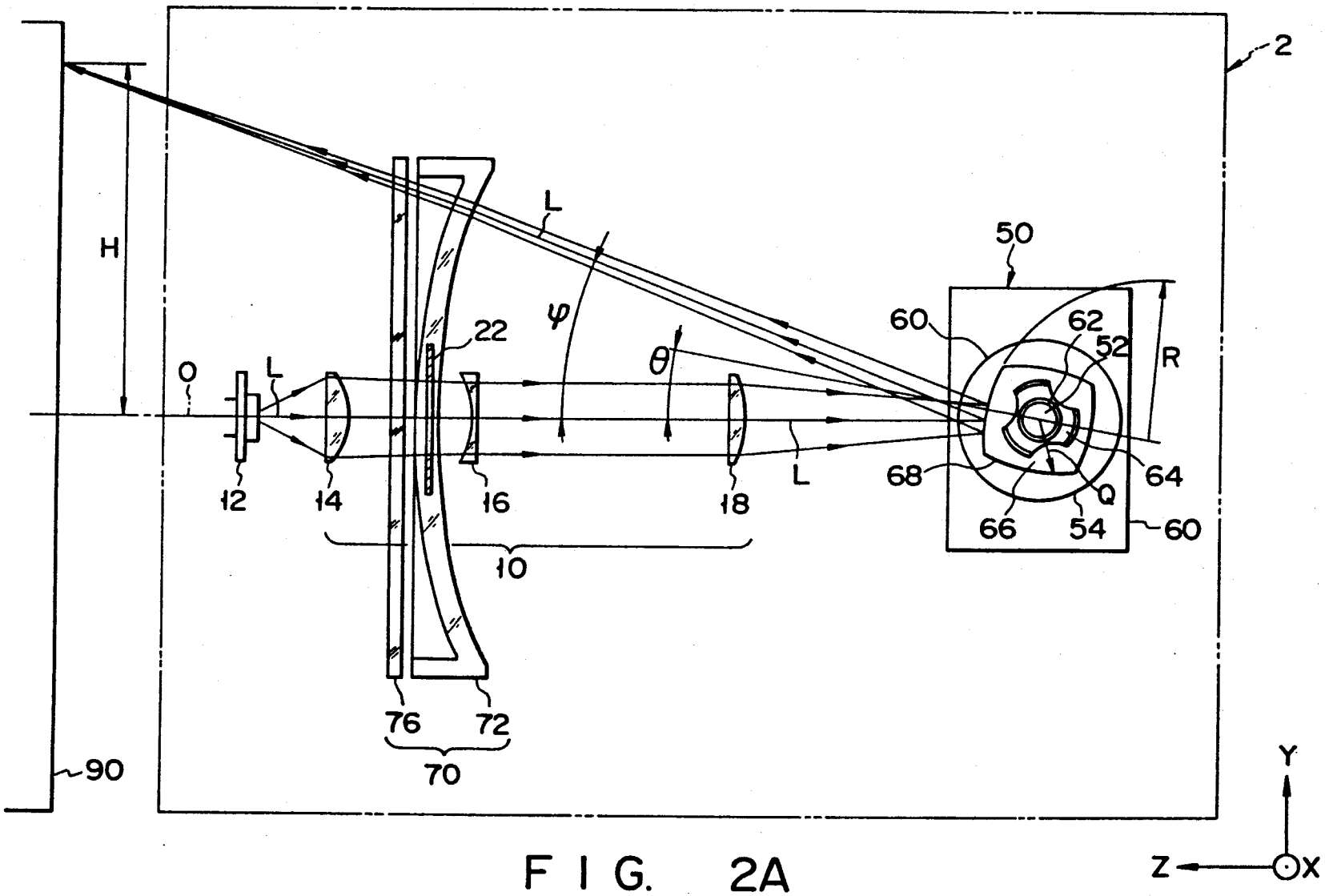
FIG. 2A is a plan view showing the arrangement of optical components of the optical unit, along with laser beam paths.
Figure 2B:
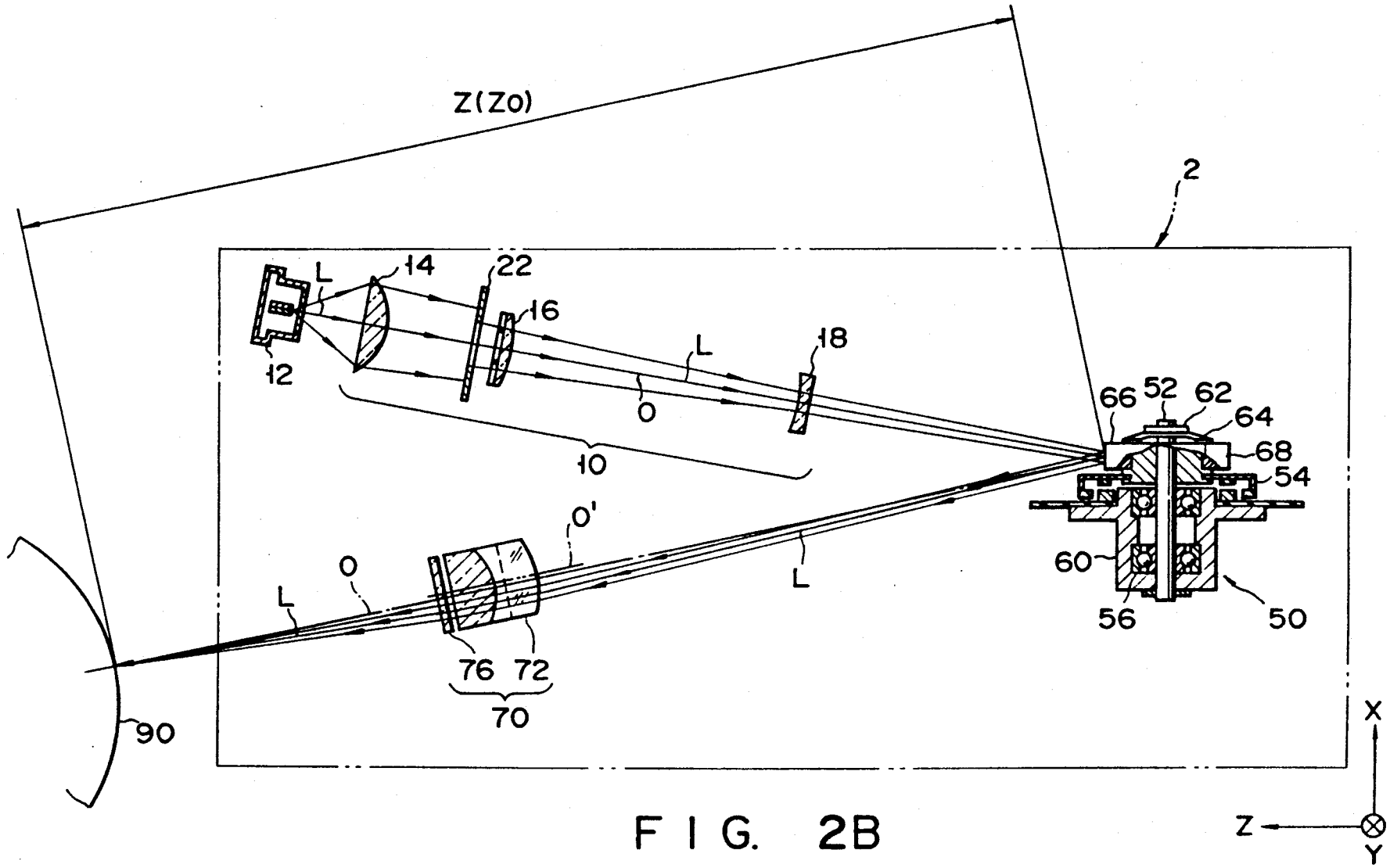
FIG. 2B is a sectional view showing the laser beam paths, the sectional view being obtained by taking the plan view shown in FIG. 2A along a plane which is in the vicinity of a center determined with reference to a body scanning direction.

As is shown in FIGS. 1A and 1B, an optical unit 2 is provided with an outer housing 6 and a base plate 8. The base plate 8 covers the outer housing 6 and seals the interior of the optical unit 2. The base plate 8 constitutes part of a laser beam printer. The optical unit 2 contains: a laser diode 12 for generating a laser beam L; a laser scanning device 4 made up of a first optical system 10 and a scanner 50 which are integrally arranged; and a second optical system 70. The first optical system 10 includes a group of conversion lenses, while the second optical system 70 includes a group of focusing lenses. Although not shown, the optical unit 2 further contains a monitoring optical device which monitors horizontally synchronize or not a laser beam L and data signal, guided through the first and second optical systems 10 and 70 and used for scanning a photosensitive body 90.

Figure 3A:
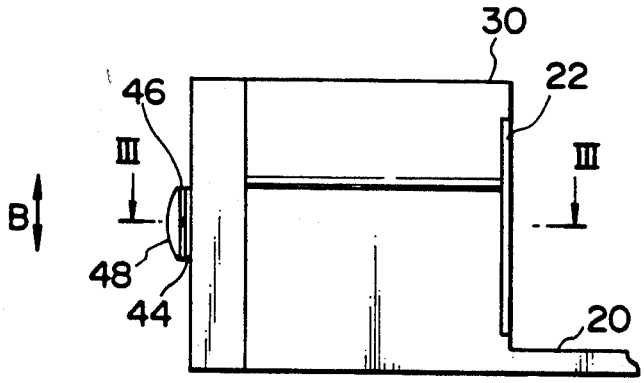
FIG. 3A is a side view of a lens barrel which is to be incorporated in the optical unit shown in FIGS. 1A and 1B and by which a focusing optical system, a light source, etc. are secured.
Figure 3B:
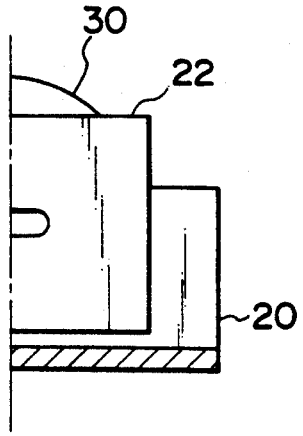
FIG. 3B is a right side view of the lens barrel shown in FIG. 3A.
Figure 3C:
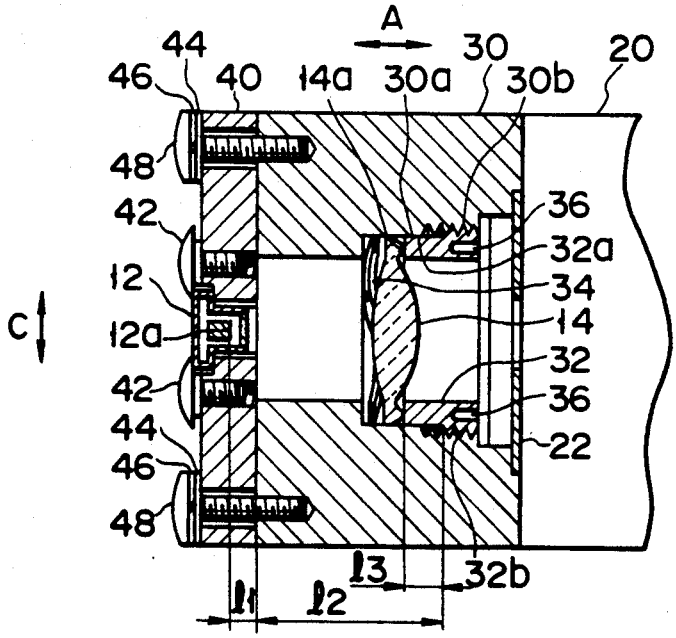
FIG. 3C is a sectional view taken along line III—III shown in FIG. 3A.

The laser scanning device 4 is mounted on an insulating base 4*a*. This insulating base 4*a* need not be used if the outer housing 6 is formed of an insulating material. As is shown in FIGS. 3A-3C, the laser diode 12 and at least one lens of the first optical system 10 are assembled in such a manner as to constitute a lens barrel 30.

The laser beam L generated by the laser diode 12 is converged when it passes through the first optical system 10. The laser beam L is directed to the scanner 50, by which the laser beam L is deflected toward the second optical system 70, for scanning it at a nonuniform angular velocity. The laser beam L should reach the point is determined by the angle at which the reflecting face of the scanner 50 is rotated to correspond to the desirable point on the surface of the photosensitive body 90, i.e., the distance for which the laser beam L scans the photosensitive body in the main scanning direction from the center of the optical axis to a given point. The laser beam directed from the second optical system 70 is focused on the photosensitive body 90 is modified or ON-OFF controlled by additional units such as a beam modulator, a data input circuit, etc., (not shown), to thereby supply character data and/or graphics data to the circumferential surface of the photosensitive body 90. Therefore, an electrostatic latent image is formed on the circumferential surface of the photosensitive body 90.

The photosensitive body 90 is rotated in a predetermined direction by a driver (not shown). The electrostatic latent image is formed in accordance with the rotation of the photosensitive body 90. The electrostatic latent image, thus formed, is developed by a developing means (not shown), and is then transferred onto a given transferring material (not shown).

Part of the laser beam L passing through the second optical system 70 is reflected by a horizontal synchronization-detecting mirror (not shown) at each scan performed in the main scanning direction. The reflected laser beam L is guided to a synchronization signal detector (not shown), for the detection of horizontal synchronization.

The first optical system 10 includes: a glass lens 14 which slightly converges the laser beam L produced by the laser diode 12; and first and second plastic lenses 16 and 18 which further converge the laser beam converged by the glass lens 14.

The glass lens 14 is a convex lens formed of optical glass, such as BK7, SK10, etc. As is seen in FIGS. 3A-3C, it has 14*a* by means of which it is held to a lens barrel 30. The first plastic lens 16 is formed of, e.g., polymethyl methacrylate (PMMA), etc., and has a toric surface. The toric surface has negative power in the main scanning direction and slightly-negative power in the sub-scanning direction. Although not shown, the first plastic lens 16 has a flange by means of which it is attached to a housing 20. It also has either a positioning-projection or a positioning-recess formed substantially at the center with respect to the main scanning direction.

Like the first plastic lens 16, the second plastic lens 18 is formed of PMMA, etc. It has a toric surface. The toric surface has positive power in the main scanning direction and negative power in the sub-scanning direction. Although not shown, the second plastic lens 18 has a flange by means of which it is attached to the housing 20. It also has either a positioning-projection or a positioning-recess formed substantially at the center with respect to the main scanning direction.

The scanner 50 includes a polygonal mirror 66 having a plurality of deflecting mirror surfaces 68. Each deflecting mirror surface 68 is a convex in the main scanning direction, i.e., the deflecting mirror surface 68 is curved with a predetermined radius R of curvature. The number of deflecting mirror surfaces 68 is four, or a multiple of four. The polygonal mirror 66 is driven by an axial gap type motor 60. This motor 60 contains: a rotor 54 which is integral with the rotating shaft 52 of the motor 60; a direct bearing 56 which supports the rotating shaft 52 in such a manner as to allow smooth rotation; etc. The polygonal mirror 66 is reliably fixed to the rotor 54 by means of a stop ring 62 and a spring member 64.

The second optical system 70 includes a third plastic lens 72 for focusing a laser beam L on the surface of the photosensitive body 90, and a dust-preventing cover 76 for sealing the above-mentioned optical members of the optical unit 2. With respect to the main scanning direction, the third plastic lens 72 has a face which is shaped to satisfy the relation expressed by $H=f\theta$. In other words, the distance over which the laser beam L ought to move from optical axis in the main scanning direction in proportion to the angle $\theta$ at which the polygonal mirror 66 or each mirror surface 68 thereof is rotated, is made to correspond to the distance H for which the laser beam L scans the photosensitive body 90 in the main scanning direction from the center of the optical axis. With respect to the sub-scanning direction, the third plastic lens 72 functions as a kind of $f\theta$ lens which has positive power and which is curved such that the power decreases in accordance with an increase in the deflection angle $\phi$ with respect to the main scanning direction. Like the first plastic lens 16, the third plastic lens 72 is formed of PMMA, etc., and has either a positioning-projection or a positioning-recess (not shown) formed substantially in the center with respect to the main scanning direction.

The dust-preventing cover 76 is a transparent glass or plastic plate. It is formed of loptical glass, such as BK7, filter glass, PMMA, or the like. It has a thickness of 2-3 mm, and permits the laser beam L to pass therethrough. In order to prevent signal components of undesirable wavelengths from reaching the photosensitive body 90, the dust-preventing cover 76 may be provided with a sharp cut filter function.

In the optical unit 2, the first optical system 10 and the second optical system 70 are arranged such that their optical axes form a predetermined angle in a plane expanding in the sub-scanning direction.

As will be detailed with reference to FIGS. 3A-3C, the glass lens 14 and the laser diode 12 are integrally assembled together and are held in a holding member or a lens barrel 30. It is known that the lens barrel 30 expands or contracts in accordance with a change in the ambient temperature. It is also known that the characteristics, for example, the intensity, wavelength, etc., of a laser beam L generated by the laser diode 12 vary in accordance with the change in the ambient temperature. If the ambient temperature increases, the lens barrel 30 expands, thus lengthening the distance between the laser diode 12 and the glass lens 14. As a result, the size of the beam spot formed by the laser beam L increases more or less. At the same time, however, the wavelength of the laser beam L generated by the laser diode 12 is shortened in accordance with the increase of the ambient temperature. As a result, the size of the beam spot formed by the laser beam L decreases more or less. Therefore, the lens barrel 30 should be provided with an adequate coefficient of thermal expansion, as will be detailed later. By so doing, the increase in the distance between the laser diode 12 and the glass lens 14 and the variation in the wavelength of the laser beam L generated by the laser diode 12 can be made to cancel each other.

The laser diode 12 and lenses 14, 16 and 18 of the first optical system 10 are integrally assembled together and are held by the housing 20. The housing 20 contains the lens barrel 30 which will be detailed later with reference to FIGS. 3A-3C. A stop 22 which restricts the intensity or amount of convergent laser beam L, and a first mirror 24 which is arranged between the first and second plastic lenses 16 and 18 to change the traveling direction of the laser beam L, are also held by the housing 20. It should be noted that a second mirror 74 is arranged between the third plastic lens 72 and the dust-preventing cover 76, so as to bend the laser beam L.

The laser beam L generated by the laser diode 12 is converged or collimated by the glass lens 14. When passing through the stop 22, the laser beam L is shaped to have a predetermined cross section. The laser beam L emerging from the stop 22 is guided to the first plastic lens 16. When passing through the first plastic lens 16, the laser beam L is collimated in the main scanning direction and is converged in the sub-scanning direction. The laser beam L, thus processed, is then directed to the second plastic lens 18 via the first mirror 24, as is seen in FIGS. 1A and 1B. When passing through the second plastic lens 18, the laser beam L is converged in both the main scanning direction and subscanning direction.

The laser beam L emerging from the second plastic lens 18 is directed to one deflecting mirror surface 68 of the polygonal mirror 66 of the scanner 50. After being reflected by the deflecting mirror surfaces 68, the laser beam L is directed at a nonuniform angular velocity to the third plastic lens 72, which functions as a kind of $f\theta$ lens, as mentioned above. In the main scanning direction, the third plastic lens 72 suppresses the adverse effects caused by the field curve and corrects the distortion aberration to have a desirable value. In the sub-scanning direction, the third plastic lens 72 corrects a positional shift which the laser beam L on the photosensitive body 90, even if the each mirror surface 68 of the polygonal mirror 66 tilt.

The laser beam L emerging from the third plastic lens 72 is directed to the photosensitive body 90 by way of the dust-preventing cover 76 which is mounted on the housing 6 of the optical unit 2.

Next, a description will be given of a structure used for converting the laser beam L generated by the laser diode into a laser beam L having a cross section of desirable size.

Referring to FIGS. 3A-3C, the glass lens 14 is secured to the lens barrel 30 by means of a push member 32 and an elastic member 34, e.g., a wave washer, etc. The push member 32 includes a cylindrical portion 32*a* and a screw portion 32*b*. The cylindrical portion 32*a* has a pressing part on that side which contacts the glass lens 14. The position of the glass lens 14 can be adjusted in the direction indicated by arrow A by turning the push member 32. The glass lens 14 has a flange 14*a*. Since this flange 14*a* and the pressing part of the cylindrical portion 32*a* are in line contact with each other, the torque required for turning the push member 32 is small. On the opposite side of the pressing part, a hole 36 is formed in the push member 32. When the position of the glass lens 14 is adjusted, a specially-designed tool is inserted into the hole 36, and the push member 32 is turned by use of the tool. The wave washer 34 urges the glass lens 14 toward the push member 32, and this urging force is constantly applied to the screw portion 32*b* of the push member 32. Therefore, unnecessary force is not produced between the screw portion 32*b* of the push member 32 and the ridge of the screw portion 30*b* of the lens barrel 30. In this fashion, the glass lens 14 is accurately secured to the predetermined position of the lens barrel 30.

The laser diode 12 is fixed to a laser diode holder 40 by means of a screw 42. The position of the laser diode holder 40 can be adjusted in the directions indicated by arrows B and C, so that the laser diode holder 40 can be positioned in a desirable manner with reference to the lens barrel 30. The laser diode holder 40 is pressed against the lens barrel 30 with desirable pressure by means of a spring washer 46, a flat washer 44, and a screw 48. With this structure, the direction in which the major component of the laser beam L of the laser diode 12 is emitted can be easily adjusted with reference to the optical axis of the glass lens 14.

The stop 22 is adhered to the lens barrel 30 such that it is located at the rear-focal plane of the glass lens 14.

Figure 4:
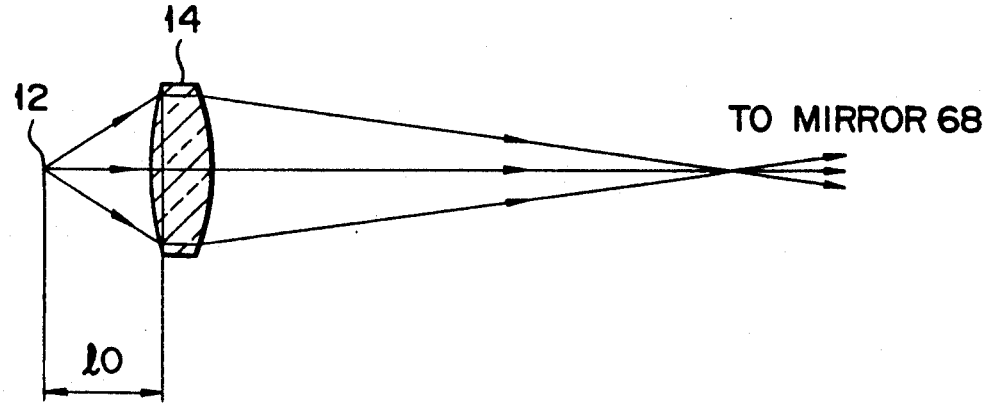
FIG. 4 is a schematic view showing how the focal length of a glass lens is related to the distance between a laser and the glass lens.

In regard to FIG. 3C, let it be assumed that:

distances $l_0$ to $l_4$ being defined between the light-emitting point of the laser diode 12 and the glass lens 14;

$l_0$ denotes the distance between the laser-emitting point of the laser beam 14 and the front-focal plane of the glass lens 14 (See FIG. 4);

$l_1$ denotes the distance measured from the laser-emitting point to the contact face between the lens barrel 30 and the laser diode holder 40 (an end face of the laser diode holder 40 which is located on the side of the lens barrel 30);

$l_2$ denotes the distance measured from the above-noted contact face to an end face of the screw portion 32*b* of the push member 32 which is located on the side of the laser diode 12;

$l_3$ of denotes the distance measured from the end face of the screw portion 32*b* which is located on the laser diode 12 to an end face of the pressing part of the push member 32 which is located on the side of the laser diode 12 (the contact face between the push member 32 and the glass lens 14);

$l_4$ denotes the distance measured from the rear-focal plane of the glass lens 14 and focal plane 90' (photosensitive body 90);

$\alpha_G$ denotes the coefficient of linear expansion of the glass lens 14;

$\alpha_1$ to $\alpha_3$ denote coefficients of linear expansion which correspond to the distances $l_0$ to $l_3$, respectively;

n denotes the index of the glass lens 14;

f denotes the focal length of the glass lens 14;

$\partial n/\partial t$ denotes a rate at which the refractive power of the glass lens 14 changes in response a variation in temperature;

$\partial n/\partial \lambda$ denotes a rate at which the refractive power of the glass lens 14 changes in response a variation in wavelength;

$\partial \lambda/\partial t$ denotes a rate at which the wavelength of the laser beam generated from a light diode changes in response to a variation in temperature;

$\Delta f$ denotes a variation which focal length f may undergo due to a temperature variation; and $\Delta l_0$ denotes a variation which distance $l_0$ may undergo due to the temperature variation.

In this case, the relation between the laser diode 12 or the laser-emitting point 48 and the focal length f of the glass lens 14 is given by:

$$\frac{1}{f} = \frac{1}{l_0} - \frac{1}{l_4} \tag{1}$$

This formula (1) is differentiated by f and the following equation will be obtained:

$$-\frac{\Delta f}{f^2} = -\frac{\Delta l_0}{l_0^2} + \frac{\Delta l_4}{l_4^2} \tag{2}$$

Since the condition that the photosensitive body 90 and a focal plane (not shown) coincide with each other is $\Delta l_4 = 0$, formula (2) can be transformed as:

$$\frac{\Delta f}{f^2} \approx \frac{\Delta l_0}{l_0^2} \tag{3}$$

Formula (3) can be transformed as follows:

$$\Delta l_0 \approx l_0^2 \cdot \frac{\Delta f}{f^2} \tag{4}$$

By this formula, it is possible to calculate the condition under which the distance between the laser-emitting point of the laser diode 12 and the glass lens 14 is constantly equal to the focal length f of the glass lens 14.

It should be noted that the formula (5) below is established:

$$\frac{\partial f}{\partial t} = -f\left\{\frac{1}{n-1}\cdot\left(\frac{\partial n}{\partial t} + \frac{\partial n}{\partial \lambda}\cdot\frac{\partial \lambda}{\partial t}\right) - \alpha_G\right\} \tag{5}$$

Since $\Delta f$ is expressed as below, $$\Delta f = \frac{\partial f}{\partial t}\cdot \Delta t \tag{6}$$

the formula (6) below can be obtained:

$$\Delta f = -f\left\{\frac{1}{n-1}\cdot\left(\frac{\partial n}{\partial t} + \frac{\partial n}{\partial \lambda}\cdot\frac{\partial \lambda}{\partial t}\right) - \alpha_G\right\}\cdot \Delta t \tag{7}$$

From formulas (4) and (7), the following formula can be derived:

$$\Delta l_0 \approx \frac{l_0^2}{f}\left\{\frac{1}{n-1}\cdot\left(\frac{\partial n}{\partial t} + \frac{\partial n}{\partial \lambda}\cdot\frac{\partial \lambda}{\partial t}\right) - \alpha_G\right\}\cdot \Delta t \tag{8}$$

If $\alpha M$ represents coefficients of expansion of the lens barrel 30 and the laser diode holder 40 summing-thermal which are located between the laser diode 12 and the glass lens 14 then $\Delta l_0$ can be expressed as follows:

$$\Delta l_0 \approx \alpha_M \cdot l_0 \cdot \Delta t \tag{9}$$

Therefore, the formula (10) below is obtained by substituting formula (9) for formula (8), $$\alpha_M \approx \frac{l_0}{f}\left\{-\frac{1}{n-1}\cdot\left(\frac{\partial n}{\partial t} + \frac{\partial n}{\partial \lambda}\cdot\frac{\partial \lambda}{\partial t}\right) + \alpha_G\right\} \tag{10}$$

According to the experiments conducted by the present inventor, satisfactory results were obtained when formula (10) was satisfied. One example of the experiments will be described.

EXAMPLE

The glass lens 14 was formed of SK10, and the lens barrel 30 and the laser diode holder 40 located between the laser diode 12 and the glass lens 14 was formed of high manganese steel. In the experiment, the following data was used:

$f = 11.461$ mm;

$l_0 = 13.322$ mm;

$\frac{\partial n}{\partial t} = 2.2 \times 10^{-6}$/°C.;

$\frac{\partial n}{\partial \lambda} = -2.7 \times 10^{-5}$/nm;

$\frac{\partial \lambda}{\partial t} = 0.2$ nm/°C.;

$n = 1.61574$ $\alpha_G$ $6.8 \times 10^{-6}$/°C.;

$\alpha_M$ $13.9 \times 10^{-6}$/°C.

When this data was used, the right and left sides of formula (10) were calculated as follows:

(right side) $= 13.945 \times 10^{-6}$ (left side) $= 13.9 \times 10^{-6}$

Accordingly, formula (10) was satisfied.

In the meantime, the following formula (11) is derived from formula (10):

$$\frac{l_0}{f} \approx -\frac{\frac{1}{n-1}\cdot\left(\frac{\partial n}{\partial t}+\frac{\partial n}{\partial \lambda}\cdot\frac{\partial \lambda}{\partial t}\right)+\alpha_G}{\alpha_M} \quad (11)$$

This formula shows that the thermal expansion of both the lens barrel 30 and the laser diode holder 40 can be used for allowing a variation which the focal length f of the glass lens 14 may undergo due to a temperature change.

By applying formula (11) to the lens barrel 30 and the laser diode holder 40 shown in the Example above, the following equation can be obtained:

$$l_0/f = 1.15862$$

The coefficient of linear expansion of an industrial material which can be used for forming a general type of holding member is approximately within the range of $5.0\times10^{-6}$ to $28.0\times10^{-6}$. By applying formula (11) to such a material, the following relationships are obtained:

$$0.41677 \leqq l_0/f \leqq 2.339170$$

Figure 5:
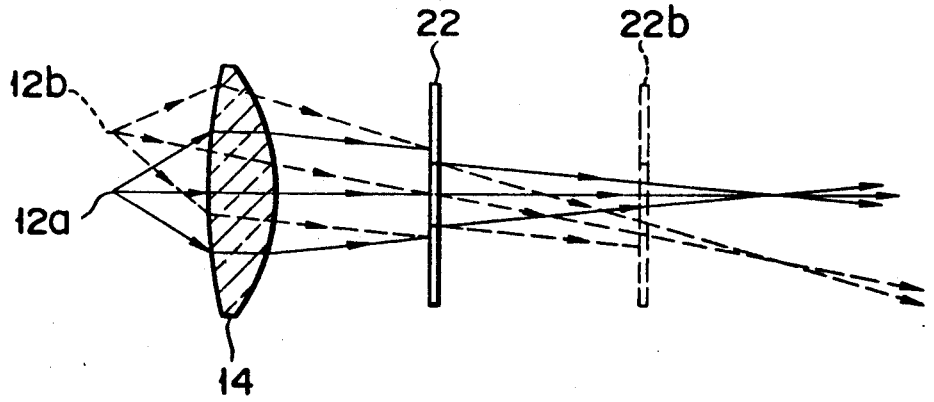
FIG. 5 is a schematic sectional view illustrating the positional relationship between the lens barrel shown in FIGS. 3A-3C and a stop used for restricting the amount of laser beam generated by a laser diode.

Referring to FIG. 5, a laser beam L is generated from the laser-emitting point 12*a* of the laser diode 12. The laser beam L is converged by the glass lens 14 and restricted by the stop 22 located at the rear-focal plane the glass lens 14, in such a manner that the laser beam L forms a beam spot of predetermined size. Thereafter, the laser beam L is directed to the photosensitive body 90. Let it be assumed that the stop 22 is located at a position away from the rear-focal plane of the glass lens L, for example, at the position 22*b* indicated by the broken lines in FIG. 5. In this case, the amount of laser beam L passing through the stop 22 is greatly varied, depending upon the location of the laser-emitting point 12*a* of the laser diode 12. If the laser-emitting point 12*a* is shifted to the position indicated by 12*b*, the amount of laser beam L passing through the stop 22 reduces approximately to half. In other words, in the case where the stop 22 is located at the rear-focal plane of the glass lens 14, the intensity or amount of laser beam L directed to the photosensitive body 90 can remain substantially unchanged, even if the direction in which the major component of the laser beam generated by the laser diode 12 passes and the optical axis of the glass lens 14 are shifted from each other.

As mentioned above, in the present invention, the distance between the laser diode and the glass lens is corrected in accordance with the temperature change by utilizing the thermal expansion of the housing or lens barrel which holds both the laser diode and the glass lens. Therefore, a temperature-dependent focal length variation which the glass lens may undergo and which cannot be corrected by the lens arrangement or the aberration removal can be corrected in accordance with a temperature change, with no need to employ a mechanical or an electrical focus-correcting means. Since, therefore, the temperature-dependent variation in the focal point of a laser beam can be suppressed, it is possible to obtain an optical unit having stable characteristics. Moreover, since the optical unit of the present invention can employ a plastic lens whose focal length is likely to vary in response to a temperature change, the cost for manufacturing the optical unit can be reduced, accordingly.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. An optical unit comprising:

means for generating a light beam;

means for converting said light beam generated by said generating means into a convergent light beam; and means, which is extendable in a predetermined manner in response to a temperature change, for holding said generating means and said converting means wherein a distance between said generating means and said converting means is adjusted in accordance with said temperature change.

2. An optical unit according to claim 1, wherein:

said converting means includes at least one glass lens located on a side on which said light beam is incident; and said converting means and said holding means satisfy the following formula:

$$0.4 \leqq l_0/f \leqq 2.4 \quad (1)$$

where $l_0$ is the distance between said generating means and a front-focal plane of said glass lens; and f is the focal length of said glass lens.

3. An optical unit according to claim 1, wherein a change in a focal length of said converting means and a change in a wavelength of said light beam, both due to a change in ambient temperature, are compensated for by a change in said distance due to thermal expansion of said holding means.

4. An optical unit according to claim 1, wherein a cross-section of said convergent light beam is held constant in response to said temperature change.

5. An optical unit comprising:

means for generating a light beam;

means for converting said light beam generated by said generating means into a convergent light beam, said converting means including at least one glass lens located on a side on which the light beam is incident; and means, which is extendable in a predetermined manner in response to a temperature change, for holding said generating means and said converting means wherein a distance between said generating means and said converting means is adjusted in accordance with said temperature change, said holding means being combined with said converting means in such a manner as to satisfy the following formula:

$$\alpha_M \approx \frac{l_0}{f}\left\{-\frac{1}{n-1}\cdot\left(\frac{\partial n}{\partial t}+\frac{\partial n}{\partial \lambda}\cdot\frac{\partial \lambda}{\partial t}\right)+\alpha_G\right\} \quad (2)$$

where $l_0$ is the distance between said generating means and a front-focal plane of said glass lens;

$\alpha_G$ is a coefficient of linear expansion of a material used for forming said glass lens;

n is a refractive index of said glass lens;

f is a focal length of said glass lens;

$\partial n/\partial t$ is a rate at which the refractive power of said glass lens changes in response a variation in temperature;

$\partial n/\partial \lambda$ is a rate at which the refractive power of said glass lens changes in response a variation in wavelength;

$\partial \lambda/\partial t$ is a rate at which the wavelength of said light beam generated by said generating means changes in response to a variation in temperature; and $\alpha_M$ is a coefficient of summing-thermal expansion of said holding means;

means for reflecting said convergent light beam output from said converting means toward an object to be scanned; and means for focusing said convergent light beam reflected by said reflecting means on a desirable position on said object to be scanned, while simultaneously causing said convergent light beam to have a cross section of desirable size.

6. An optical unit comprising:

means for generating a light beam;

means for converting said light beam generated by said generating means into a convergent light beam, said converting means including at least one glass lens located on a side on which said light beam is incident;

means, which is extendable in a predetermined manner in response to a temperature change, for holding said generating means and said converting means wherein a distance between said converting means is adjusted in accordance with said temperature change said holding means being combined with said converting means in such a manner as to satisfy the following formula:

$$0.4 \leqq l_0/f \leqq 2.4 \quad (3)$$

where $l_0$ is the distance between said generating means and a front-focal plane of said glass lens; and f is the focal length of said glass lens.

7. An optical unit comprising:

means for generating a light beam;

means for converting said light beam generated by said generating means into a convergent light beam, said converting means including at least one glass lens located on a side on which the light beam is incident; and means, which is extendable in a predetermined manner in response to a temperature change, for holding said generating means and said converting means wherein a distance between said generating means and said converting means is adjusted in accordance with said temperature change, said holding means being combined with said converting means in such a manner as to satisfy the following formula:

$$\alpha_M \approx \frac{l_0}{f}\left\{-\frac{1}{n-1}\cdot\left(\frac{\partial n}{\partial t}+\frac{\partial n}{\partial \lambda}\cdot\frac{\partial \lambda}{\partial t}\right)+\alpha_G\right\} \quad (4)$$

where $l_0$ is the distance between said generating means and a front-focal plane of said glass lens;

$\alpha_G$ is a coefficient of linear expansion of a material used for forming said glass lens;

n is a refractive index of said glass lens;

f is a focal length of said glass lens;

$\partial n/\partial t$ is a rate at which the refractive power of said glass lens changes in response a variation in temperature;

$\partial n/\partial \lambda$ is a rate at which the refractive power of said glass lens changes in response a variation in wavelength;

$\partial \lambda/\partial t$ is a rate at which the wavelength of said light beam generated by said generating means changes in response to a variation in temperature; and $\alpha_M$ is a coefficient of summing-thermal expansion of said holding means.

8. An optical unit according to claim 7, wherein said glass lens of said converting means comprises;

a glass lens portion having a spherical surface; and an aspheric-surface layer formed on said spherical surface of said glass lens portion and made of a different material from that of said glass lens portion.

* * * * *